US009886935B2

(12) United States Patent
Xiong et al.

(10) Patent No.: US 9,886,935 B2
(45) Date of Patent: Feb. 6, 2018

(54) METHOD AND SYSTEM FOR DRIVING DISPLAY PANEL

(71) Applicant: Shenzhen China Star Optoelectronics Technology Co., Ltd., Shenzhen, Guangdong (CN)

(72) Inventors: Zhengsong Xiong, Guangdong (CN); Liwei Zhu, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 14/785,942

(22) PCT Filed: Apr. 24, 2015

(86) PCT No.: PCT/CN2015/077416

§ 371 (c)(1),
(2) Date: Dec. 30, 2015

(87) PCT Pub. No.: WO2016/165158

PCT Pub. Date: Oct. 20, 2016

(65) Prior Publication Data

US 2017/0140735 A1 May 18, 2017

(30) Foreign Application Priority Data

Apr. 16, 2015 (CN) ..... 2015 1 0180647

(51) Int. Cl.
*G09G 5/18* (2006.01)
*G09G 5/00* (2006.01)

(52) U.S. Cl.
CPC ..... *G09G 5/18* (2013.01); *G09G 5/003* (2013.01); *G09G 2310/08* (2013.01); *G09G 2320/0247* (2013.01)

(58) Field of Classification Search
CPC ..... G05G 5/18; G09G 5/003; G09G 2310/08; G09G 2320/0247
See application file for complete search history.

(56) References Cited

U.S. PATENT DOCUMENTS 6,040,828 A * 3/2000 Park ..... G09G 3/3677 345/212
6,937,538 B2 * 8/2005 Terzioglu ..... G11C 7/06 326/108
7,173,867 B2 * 2/2007 Terzioglu ..... G11C 29/848 365/189.05
7,817,338 B2 * 10/2010 Sagawa ..... G03B 21/10 359/443
2005/0140571 A1 * 6/2005 Hara ..... G09G 5/005 345/3.1
2013/0028337 A1 * 1/2013 Nishio ..... H04N 21/4302 375/240.28
2013/0207961 A1 * 8/2013 Park ..... G09G 5/18 345/214

* cited by examiner

*Primary Examiner* — Sejoon Ahn
(74) *Attorney, Agent, or Firm* — Kim Winston LLP

(57) ABSTRACT

Disclosed is a method and system for driving a display panel, which relates to the technical filed of displays, and is able to solve the technical problem of undesired display effect resulting from flickers and blurred screens appeared on areas between the sub-areas of the display device. The present disclosure can be used in liquid crystal televisions, liquid crystal display devices, mobile phones, tablet PCs, etc.

6 Claims, 2 Drawing Sheets

METHOD AND SYSTEM FOR DRIVING DISPLAY PANEL

The present application claims benefit of Chinese patent application CN201510180647.1, entitled "Method and system for driving a display panel" and filed on Apr. 16, 2015, the entirety of which is incorporated herein by reference.

TECHNICAL FIELD

The present disclosure relates to the technical field of displays, and in particular, to a method and system for driving a display panel.

TECHNICAL BACKGROUND

With the improvement of living standard and production technology, consumers are now showing an increasing preference for display panels with high added values, especially for display panels with full high definition (FHD) and ultrahigh definition (UHD).

However, the research and development of timing controller (TCON) integrated circuits (IC) usually fall behind those of display panels. Consequently, when manufacturing FHD and UHD large-screen display devices, manufacturers have to utilize a number of TCON ICs suitable for low definition display devices, and form display devices with high resolution (e.g., 4K2K/8K4K/16K8K or higher) or singular resolution (e.g. 3K1K/5K2K/8K3K or other unconventional resolution) by a combination of a plurality of screens. For example, a display device with a resolution of 4K2K (definition: 3840×2160) can be formed by combining four screens each with a resolution of 2K1K (definition: 1920×1080), and a display device with a resolution of 8K4K (definition: 7680×4320) can be formed by combining sixteen screens each with a resolution of 2KIK.

FIG. 1 shows structures of existing display devices with full high resolution, high definition, or lower definition. These devices have been developed for a long time, and therefore have been provided with suitable TCON ICs, and thus do not need a plurality of TCON ICs to help with the driving thereof. Moreover, since these display devices are provided with a signal source that generates only one signal, there is no problem concerning the synchronization of signals, and the display effects of these display devices are fairly satisfactory.

FIG. 2 shows a currently mainly-used high definition display device formed by a combination of TCON ICs suitable for low definition screens (Here, a combination of four sub-areas is taken as an example, and the number of the sub-areas can also be two, eight, sixteen, or any integer). Since this type of display devices is provided with a signal source that generates multiple signals (In FIG. 2, four signals is generated by the signal source), the synchronization processor in the display device is required to have a great storage and calculation capacity to synchronize these signals generated by the signal source. Then, after being processed by a control board system and a TCON IC, the processed signals can be output to the display device formed by a combination of a plurality of sub-areas.

However, the inventor found that when the signals corresponding to each of the sub-areas pass through the control board system and the TCON IC, they are affected, to different degrees, by the transmission routes thereof and other factors, and therefore cannot be input into the display device synchronously. This leads to flickers and blurred screens on the areas between different sub-areas, thus decreasing the display effect of the display device.

SUMMARY OF THE INVENTION

The objective of the present disclosure is to provide a method and system for driving a display panel, whereby the technical problem of undesired display effect resulting from flickers and blurred screens appeared on areas between the sub-areas of the display device can be solved.

The present disclosure, at one aspect, provides a method for driving a display panel. The display panel comprises N identically sized sub-areas, each of which displays a sub-image that is 1/N of a full frame of image, N being an integer and N≥2. The method comprises the following steps of: obtaining, from a front end of the display panel, data signals output by timing controllers corresponding the respective sub-areas, and matching and binding the data signals on same rows of each of the sub-areas in a same frame of image; obtaining, from the front end of the display panel, various types of control signals output by the timing controllers corresponding to the respective sub-areas, and synchronizing same types of control signals of each of the sub-areas, so as to obtain various types of synchronous control signals; and outputting the various types of synchronous control signals to the display panel, and outputting the matched and bound same rows of data signals of each of the sub-areas.

The step of outputting the various types of synchronous control signals to the display panel and outputting the matched and bound same rows of data signals of each of the sub-areas comprises: synchronizing start vertical signals output by the timing controllers corresponding to the respective sub-areas to obtain synchronous start vertical signals; determining, based on the synchronous start vertical signals, a time to send the matched and bound same rows of data signals and a time to output synchronous clock signals; and sending, when rising edges of the synchronous clock signals among the synchronous control signals sent to the display panel come, the matched and bound same rows of data signals of each of the sub-areas which are corresponding to the synchronous clock signals.

The step of synchronizing the same types of control signals of each of the sub-areas to obtain the various types of synchronous control signals comprises processing each of the same types of control signals of each of the sub-areas by performing an AND operation thereon, so as to obtain the various types of synchronous control signals.

The step of obtaining, from the front end of the display panel, the data signals output by the timing controllers corresponding to the respective sub-areas and matching and binding the data signals on the same rows of each of the sub-areas in the same frame comprises: obtaining the data signals output by the timing controllers corresponding to the respective sub-areas; determining connection and coherence of the connection between currently fed rows of data signals of the transversely connected sub-areas; and binding and caching each row of the data signals when the connection and coherence of the connection between the currently fed rows of data signals of the transversely connected sub-areas are confirmed.

The method, when a presence of disconnection or incoherence of the connection between the currently fed rows of data signals of the transversely connected sub-areas is determined, further comprises: caching each row of the data signals, which are to be compared with rows of data signals obtained at a subsequent time, and substituting, if it is found that two rows of data signals of a sub-area obtained at different times are the same, the row of data signals obtained at the subsequent time with the row of data signals obtained at a prior time, which are then matched with other rows of data signals obtained at the subsequent time, and binding and caching, if the match succeeds, the row of data signals obtained at the prior time and said other rows of data signals obtained at the subsequent time.

The present disclosure achieves the following beneficial effects. According to the method for driving a display panel provided by the embodiments of the present disclosure, the data signals and control signals output by the timing controllers corresponding to the respective sub-areas are synchronized at the front end of the display panel, and then transmitted to the display panel directly. The method reduces the possibility of non-synchronization of signals of each of the sub-areas, thereby avoiding blurred screens and flickers on areas between the sub-areas, and thus ensuring the display effect of high definition or ultrahigh definition display device.

The present disclosure, at another aspect, provides a system for driving a display panel. The display panel comprises N identically sized sub-areas, each of which displays a sub-image that is 1/N of a full frame of image, N being an integer and N≥2. The driving system comprises a plurality of timing controllers corresponding to the respective sub-areas, and a synchronization processor located between the timing controllers and the display panel, the synchronization processor including a data control module and a timing control module. The data control module is configured to obtain data signals output by the timing controllers corresponding to the respective sub-areas, and match and bind the data signals on same rows of each of the sub-areas in a same frame of image. The timing control module is configured to obtain various types of control signals output by the timing controllers corresponding to the respective sub-areas, and synchronize same types of control signals of each of the sub-areas to obtain synchronous control signals. The timing control module is configured to output the synchronous control signals to the display panel, and the data control module is configured to output the matched and bound same rows of data signals of each of the sub-areas.

The timing control module is configured to synchronize start vertical signals output by the timing controllers corresponding to the respective sub-areas so as to obtain synchronous start vertical signals, and send the synchronous start vertical signals to the data control module. The data control module is configured to feed back a response signal to the timing control module based on the received synchronous start vertical signals, and simultaneously send a first row of data signals of each of the sub-areas in the present frame of image. The timing control module is configured to output, after receiving the response signal, synchronous clock signals among the various type of synchronous control signals. The data control module is configured to output, when rising edges of the synchronous clock signals among the synchronous control signals sent by the timing control module to the display panel come, the matched and bound same rows of data signals of each of the sub-areas which are corresponding to the synchronous clock signals.

The step of synchronizing the same types of control signals of each of the sub-areas so as to obtain synchronous control signals comprises: processing each of the same types of control signals of each of the sub-areas by performing an AND operation thereon, so as to obtain the synchronous control signals.

The data control module is configured to obtain the data signal output by the timing controllers corresponding to the respective sub-areas, determine connection and coherence of the connection between the currently fed rows of data signals of the transversely connected sub-areas, and bind and cache each row of the data signals when the connection and coherence of the connection between the currently fed rows of data signals of the transversely connected sub-areas are confirmed.

When the data control module determines a presence of disconnection or incoherence of the connection between the currently fed rows of data signals of the transversely connected sub-areas, each row of the data signals are cached, and are then compared with rows of data signals obtained at a subsequent time. If it is found that two rows of data signals of a sub-area obtained at different times are the same, the row of data signals obtained at the subsequent time are substituted with the row of data signals obtained at a prior time which are then matched with other rows of data signals obtained at the subsequent time, and if the match succeeds, the row of data signals obtained at the prior time and said other rows of data signals obtained at the subsequent time are bound and cached.

Other features and advantages of the present disclosure will be further explained in the following description, and will partly become self-evident therefrom, or be understood through the implementation of the present disclosure. The objectives and advantages of the present disclosure will be achieved through the structures specifically pointed out in the description, claims, and the accompanying drawings.

BRIEF DESCRIPTION OF THE DRAWINGS

For further illustrating the technical solutions provided in the embodiments of the present disclosure, a brief introduction will be given below to the accompanying drawings involved in the embodiments.

DETAILED DESCRIPTION OF THE EMBODIMENTS

The present disclosure will be explained in detail below with reference to the embodiments and the accompanying drawings, so that one can fully understand how the present disclosure solves the technical problem and achieves the technical effects through the technical means, thereby implementing the same. It should be noted that as long as there is no structural conflict, any of the embodiments and any of the technical features thereof may be combined with one another, and the technical solutions obtained therefrom all fall within the scope of the present disclosure.

Figure 1:
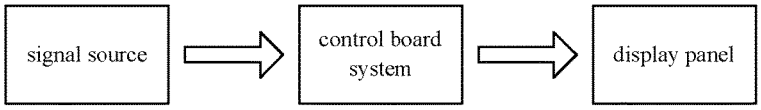
FIG. 1 schematically shows the structure of a display device in the prior art.
Figure 2:
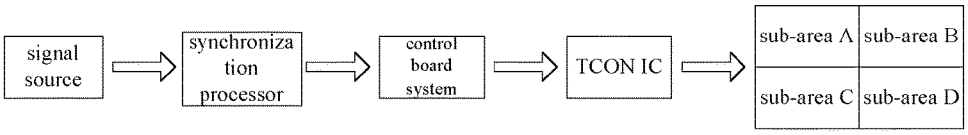
FIG. 2 schematically shows the structure of another display device in the prior art.
Figure 3:
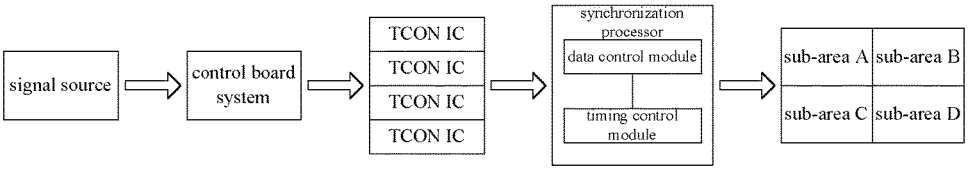
FIG. 3 schematically shows the structure of a display device according to the embodiments of the present disclosure.

The present disclosure mainly relates to a method and system for driving a display panel. The display device in the present disclosure is a large-screen display panel with full high definition or ultrahigh definition. The display panel comprises N identically sized sub-areas, each of which displays a sub-image that is 1/N of a full frame of image, N being an integer and N≥2. As shown in FIG. 3, the system comprises a signal source, a control board system, a plurality of timing controllers each corresponding to a respective one of the sub-areas, and a synchronization processor located downstream of the timing controllers and upstream of the display panel.

Specifically, as shown in FIG. 3, the synchronization processor includes a data control module and a timing control module, and is used to synchronize and match signals output by the timing controllers, so that the sub-areas of the display panel can display a same frame of image synchronously, thereby avoiding flickers and blurred screens on boundaries of the sub-areas, thus improving the display effect of large-screen high definition display panel.

Figure 4:
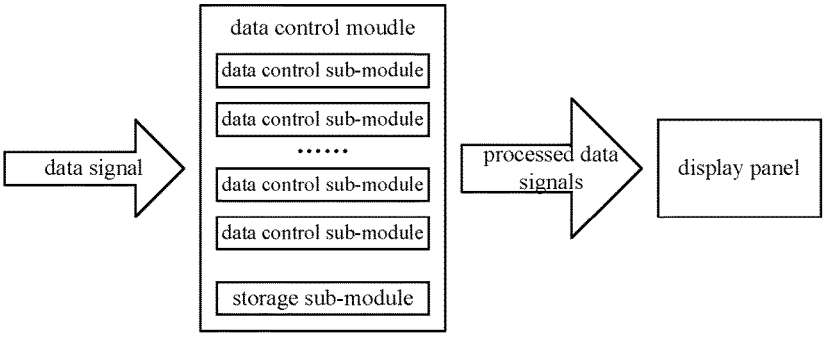
FIG. 4 schematically shows the structure of a data control module according to the embodiments of the present disclosure.

Further, as shown in FIG. 4, the data control module provided in the present embodiment comprises a plurality of data control sub-modules each corresponding to a respective one of the sub-areas. Each of the data control sub-modules obtains a data signal of a corresponding sub-area, and matches said data signal with the data signals of other sub-areas and performs processing. The data control module further comprises a storage sub-module for storing the matched and bound data signals of each of the sub-areas until they are output, and storing the data signals that are not matched.

The data control module obtains the data signals output by the timing controllers each corresponding to a respective one of the sub-areas, and matches and binds the data signals on same rows of each of the sub-areas in a same frame of image. Specifically, after the data control sub-modules of the data control module each obtain a row of data signals output by a corresponding timing controller, the data control sub-modules will coordinate with one another to match the data signals they receive, so as to determine whether the rows of the data signals received at a same time could be bound and output together or not. Specifically, it is determined whether the rows of data signals corresponding to the transversely connected sub-areas, among the multiple rows of data signals received at a same time, are connected or not, and if yes, whether they are connected coherently or not. In this manner, the data signals on same rows in a same frame of image can be matched with one another and bound to one another.

As shown in FIG. 3, supposing that the display panel is divided uniformly into four sub-areas, namely, sub-areas A, B, C, and D, wherein sub-areas A and B are transversely connected to each other, and sub-areas C and D are transversely connected to each other. The data control sub-modules of the data control module can receive one row of data signals of a corresponding sub-area at one time. For sub-areas A and B, the data control module detects whether the currently received data signals of the sub-area A and the sub-area B are data signals on a same row. For example, if sub-area A currently receives the data signals on the sixth row, and sub-area B also receives the data signals on the sixth row, it can be determined that the currently received data signals of sub-area A and sub-area B are data signals on the same row.

Further, it is necessary to detect whether there are any errors with said two rows of received data signals. In the embodiments of the present disclosure, it can be achieved by detecting whether pixels on the right-most part of the sub-area A corresponding to the data signals on the sixth row and pixels on the left-most part of the sub-area B corresponding to the data signals on the sixth row can be connected or not. If yes, it is determined that the data signals on the sixth row of sub-area A and sub-area B are matched with each other, and can be bound to each other and stored for being output when the synchronization processor outputs a corresponding synchronous control signal. Accordingly, the data control module processes the data signals of sub-areas C and D in a similar manner as above.

In addition, if the data control module determines that the currently fed rows of data signals of the transversely connected sub-areas are not connected to one another or are connected to one another incoherently, the data control module will cache the rows of data signals, which are then compared with rows of data signals obtained at a subsequent time. If it is found that two rows of data signals of a sub-area obtained at different times are the same, the row of data signals obtained at the subsequent time are substituted with the row of data signals obtained at a prior time, which are then matched with other rows of data signals obtained at the subsequent time. If the match succeeds, the row of data signals obtained at the prior time and said other rows of data signals obtained at the subsequent time are bound and cached. If, after several rounds of matching, a row of data signals are still not bound to any other row of data signals, it will be determined that said row of data signals are wrong data signals, and will then be discarded.

Figure 5:
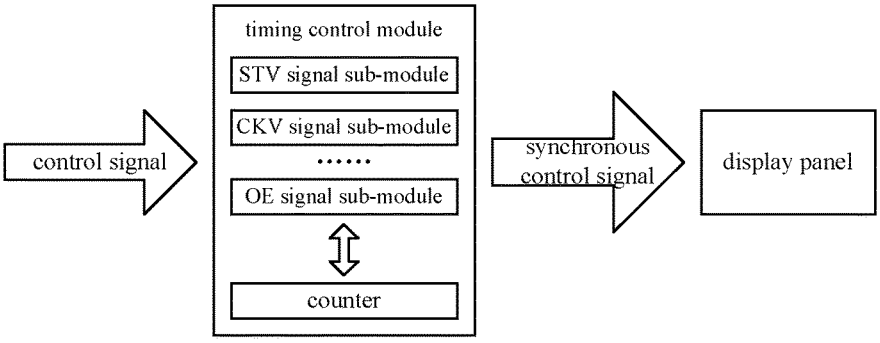
FIG. 5 schematically shows the structure of a timing control module according to the embodiments of the present disclosure.

As shown in FIG. 5, the timing control module in the embodiments of the present disclosure comprises a plurality of control signal sub-modules such as a start vertical (STV) signal sub-module, a CKV signal sub-module, an output enable (OE) signal sub-module, for processing corresponding control signals. These sub-modules can synchronize non-synchronous control signals after the processing of the timing control processors corresponding to each of the sub-areas, thus achieving synchronous displays on all the sub-areas.

Figure 6:
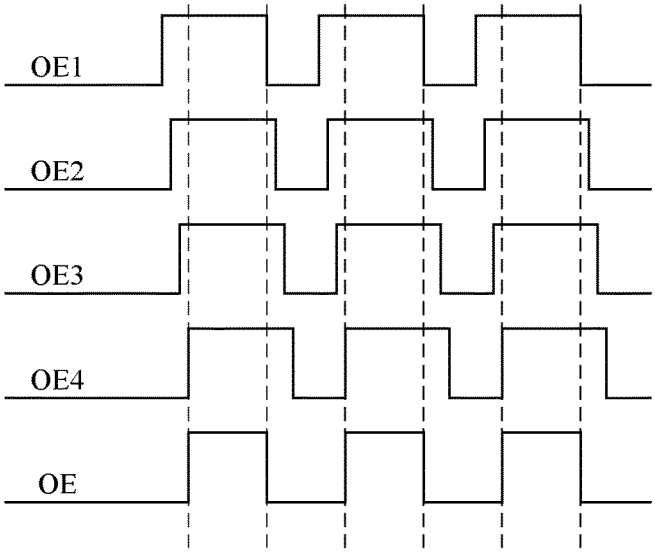
FIG. 6 schematically shows processing of the output enable signal according to the embodiments of the present disclosure.

The timing control module in the embodiments of the present disclosure is able to obtain various types of control signals output by the timing controllers corresponding to the respective sub-areas, and synchronizes the same types of control signals to obtain the synchronous control signals. For different types of control signals, the sub-modules of the timing control module can obtain a corresponding synchronous control signal in different ways. The control signal sub-modules of each of the timing control module trigger signals and counts using a flip-flop and a counter. For example, for an OE signal, supposing that when the OE signal is at a high level, the signals on each of gate lines are forced to be at a low level. Since the display device comprises four sub-areas A, B, C, and D, there will be four signals OE1, OE2, OE3, and OE4 which each correspond to a respective sub-area. Additionally, each of the OE signals corresponds to a counter. Supposing that a rising edge of the OE1 signal comes before the rising edges of three other OE signals, counter OE_CNT1 of the OE1 signal starts to count from zero, and when a falling edge of the OE1 signal is triggered, the counter OE_CNT1 returns to zero. Likewise, when rising edges and falling edges of signals OE2, OE3, and OE4 come, the corresponding counters OE_CNT2, OE_CNT3, and OE_CNT4 perform the same. As shown in FIG. 6, when the four counters are in a working state and none of the values thereof is zero, the OE signal sub-module outputs a high level, and at other times, the OE signal sub-module outputs a low level. That is, the four OE signals are processed by performing an AND operation.

Other control signals can be processed by performing an AND operation, or by other signal processing methods. The processing methods should be selected based on the requirements of the display panel for signals. The present disclosure is not restricted in this regard.

In order to enable all the sub-areas start to display a same frame of image synchronously at a same time, the timing control module and the data control module should co-work with each other. That is, the timing control module sends the synchronous control signals to the display panel, and the data control module sends the matched and bound same rows of data signals of each of the sub-areas.

The timing control module and the data control module should communicate with each other to ensure that they can start to work synchronously to display each frame of image. Specifically, the timing control module synchronizes the STV signals output by the timing controllers corresponding to the respective sub-areas so as to obtain synchronous STV signals, and sends the synchronous STV signals to the data control module, When the data control module is ready to output a first row of data signals of a current frame of image, it feeds back a response signal to the timing control module based on the received synchronous STV signal, and at the same time outputs the first row of data signals of each of the sub-areas of the current frame of image. Then, the timing control module receives the response signal and outputs the synchronous CKV signals among the synchronous control signals. Since the data control module and the timing control module are arranged closely, the speed of signal transmitting therebetween is very fast. Therefore, when the rising edges of the synchronous CKV signals among the synchronous control signals sent by the timing control module to the display panel come, the data control module outputs the matched and bound same rows of data signals of each of the sub-areas which are corresponding to the synchronous CKV signals.

In the driving system of the display panel provided by the embodiments of the present disclosure, the synchronization processor is located between the timing controllers and the display panel. The data signals and control signals output by the timing controllers are synchronized by the synchronization processor, and then transmitted to the display panel directly, which reduces the possibility of non-synchronization of signals of each of the sub-areas, thereby avoiding blurred screens and flickers on the boundaries of the sub-areas, and thus ensuring the display effect of high definition or ultrahigh definition display device.

Figure 7:
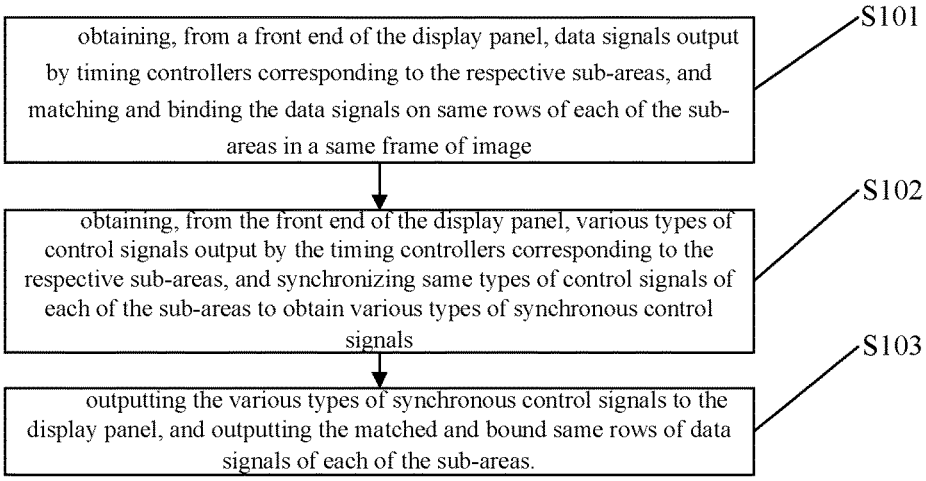
FIG. 7 schematically shows a flow chart of a method for driving the display panel according to the embodiments of the present disclosure.

Obviously, according to the aforementioned, in the embodiments of the present disclosure, the method for driving the display panel may comprises the following steps as shown in FIG. 7.

In step S101, data signals output by timing controllers corresponding to the respective sub-areas are obtained from a front end of the display panel, and same rows of data signals of each of the sub-areas in a same frame of image are matched and bound.

In step S102, various types of control signals output by the timing controllers corresponding to the respective sub-areas are obtained from the front end of the display panel, and same types of control signals of each of the sub-areas are synchronized to obtain various types of synchronous control signals.

In step S103, the various types of synchronous control signals are output to the display panel, and the matched and bound same rows of data signals of each of the sub-areas are output.

According to the method for driving the display panel provided by the embodiments of the present disclosure, the data signals and control signals output by the timing controllers corresponding to the respective sub-areas are synchronized at the front end of the display panel, and then transmitted to the display panel directly. The method reduces the possibility of non-synchronization of signals of each of the sub-areas, thereby avoiding blurred screens and flickers on the boundaries of the sub-areas, and thus ensuring the display effect of high definition or ultrahigh definition display device.

The above embodiments are described only for better understanding, rather than restricting the present disclosure. Anyone skilled in the art can make amendments to the implementing forms or details without departing from the spirit and scope of the present disclosure. The scope of the present disclosure should still be subject to the scope defined in the claims.

The invention claimed is:

1. A method for driving a display panel, wherein the display panel comprises N identically sized sub-areas, each of which displays a sub-image that is 1/N of a full frame of image, N being an integer and N≥2, and the method comprises:

obtaining, from a front end of the display panel, data signals outputted by timing controllers corresponding to the respective sub-areas, and matching and binding the data signals on same rows of each of the sub-areas in a same frame of image, wherein the step of obtaining further comprises:

obtaining the data signals outputted by the timing controllers corresponding to the respective sub-areas, determining connection and coherence of the connection between currently fed rows of data signals of the transversely connected sub-areas, and binding and caching each row of the data signals to obtain matched and bound same rows of data signals of each of the sub-areas when the connection and coherence of the connection between the currently fed rows of data signals of the transversely connected sub-areas are confirmed, when a presence of disconnection or incoherence of the connection between the currently fed rows of data signals of the transversely connected sub-areas is determined:

caching each row of the data signals, which are to be compared with rows of data signals obtained at a subsequent time, and substituting, if it is found that two rows of data signals of a sub-area obtained at different times are the same, the row of data signals obtained at the subsequent time with the row of data signals obtained at a prior time, which are then matched with other rows of data signals obtained at the subsequent time, and binding and caching, if the match succeeds, the row of data signals obtained at the prior time and said other rows of data signals obtained at the subsequent time to obtain matched and bound same rows of data signals of each of the sub-areas;

obtaining, from the front end of the display panel, various types of control signals outputted by the timing controllers corresponding to the respective sub-areas, and synchronizing same types of control signals of each of the sub-areas to obtain various types of synchronous control signals, and outputting the various types of synchronous control signals to the display panel, and outputting the matched and bound same rows of data signals of each of the sub-areas.

2. The method according to claim 1, wherein the step of outputting the various types of synchronous control signals to the display panel and outputting the matched and bound same rows of data signals of each of the sub-areas comprises:

synchronizing start vertical signals outputted by the timing controllers corresponding to the respective sub-areas to obtain synchronous start vertical signals, determining, based on the synchronous start vertical signals, a time to send the matched and bound same rows of data signals and a time to output synchronous clock signals; and sending, when rising edges of the synchronous clock signals among the synchronous control signals sent to the display panel come, the matched and bound data same rows of signals of each of the sub-areas which are corresponding to the synchronous clock signals.

3. The method according to claim 1, wherein the step of synchronizing the same types of control signals of each of the sub-areas to obtain the various types of synchronous control signals comprises:

processing each of the same types of control signals of each of the sub-areas by performing an AND operation thereon, so as to obtain the various types of synchronous control signals.

4. A system for driving a display panel, wherein the display panel comprises N identically sized sub-areas, each of which displays a sub-image that is 1/N of a full frame of image, N being an integer and N≥2, and the system comprises a plurality of timing controllers corresponding to the respective sub-areas, and a synchronization processor located between the timing controllers and the display panel, the synchronization processor including a data control module and a timing control module, wherein the data control module is configured to obtain data signals outputted by the timing controllers corresponding to the respective sub-areas, and match and bind the data signals on same rows of each of the sub-areas in a same frame of image, the data control module is configured to obtain the data signals outputted by the timing controllers corresponding to the respective sub-areas, determine connection and coherence of the connection between currently fed rows of data signals of the transversely connected sub-areas, and bind and cache each row of the data signals to obtain matched and bound same rows of data signals of each of the sub-areas when the connection and coherence of the connection between the currently fed rows of data signals of the transversely connected sub-areas are confirmed;

when the data control module determines a presence of disconnection or incoherence of the connection between the currently fed rows of data signals of the transversely connected sub-areas, each row of the data signals are cached and are then compared with rows of data signals obtained at a subsequent time, and if it is found that two rows of data signals of a sub-area obtained at different times are the same, the row of data signals obtained at the subsequent time are substituted with the row of data signals obtained at a prior time which are then matched with other rows of data signals obtained at the subsequent time, and if the match succeeds, the row of data signals obtained at the prior time and sad other rows of data signals obtained at the subsequent time are bound and cached to obtain matched and bound same rows of data signals of each of the sub-areas;

the timing control module is configured to obtain various types of control signals outputted by the timing controllers corresponding to the respective sub-areas, and synchronize same types of control signals of each of the sub-areas to obtain various types of synchronous control signals, and the timing control module is configured to output the various types of synchronous control signals to the display panel, and the data control module is configured to output the matched and bound same rows of data signals of each of the sub-areas.

5. The system according to claim 4, wherein the timing control module is configured to synchronize start vertical signals outputted by the timing controllers corresponding to the respective sub-areas so as to obtain synchronous start vertical signals, and send the synchronous start vertical signals to the data control module, the data control module is configured to feed back a response signal to the timing control module based on the received synchronous start vertical signals, and simultaneously send a first row of data signals of each of the sub-areas in the present frame of image, the timing control module is configured to output, after receiving the response signal, synchronous clock signals among the various types of synchronous control signals, and the data control module is configured to output, when rising edges of the synchronous clock signals among the synchronous control signals sent by the timing control module to the display panel come, the matched and bound same rows of data signals of each of the sub-areas which are corresponding to the synchronous clock signals.

6. The system according to claim 4, wherein synchronizing the same types of control signals of each of the sub-areas to obtain the synchronous control signals comprises:

processing each of the same types of control signals of each of the sub-areas by performing an AND operation thereon, so as to obtain the synchronous control signals.

* * * * *